US010662821B2

(12) United States Patent
Castellucci

(10) Patent No.: US 10,662,821 B2
(45) Date of Patent: May 26, 2020

(54) HEAT RECOVERY

(71) Applicant: Highview Enterprises Limited, London (GB)

(72) Inventor: Nicola Castellucci, Woking (GB)

(73) Assignee: Highview Enterprises Limited, London (GB)

( * ) Notice: Subject to any disclaimer, the term of this patent is extended or adjusted under 35 U.S.C. 154(b) by 15 days.

(21) Appl. No.: 15/763,999

(22) PCT Filed: Sep. 29, 2016

(86) PCT No.: PCT/GB2016/053037
§ 371 (c)(1),
(2) Date: Mar. 28, 2018

(87) PCT Pub. No.: WO2017/055855
PCT Pub. Date: Apr. 6, 2017

(65) Prior Publication Data

US 2018/0320559 A1 Nov. 8, 2018

(30) Foreign Application Priority Data

Sep. 29, 2015 (GB) ..... 1517213.3

(51) Int. Cl.
*F01K 23/04* (2006.01)
*F01K 7/02* (2006.01)
(Continued)

(52) U.S. Cl.
CPC ..... *F01K 23/04* (2013.01); *F01K 7/02* (2013.01); *F01K 7/16* (2013.01); *F01K 7/30* (2013.01); *F01K 25/00* (2013.01)

(58) Field of Classification Search
CPC ... F01K 23/04; F01K 7/30; F01K 7/02; F01K 25/00
See application file for complete search history.

(56) References Cited

U.S. PATENT DOCUMENTS 3,214,938 A 11/1965 Zotos
3,998,059 A 12/1976 Randell
(Continued)

FOREIGN PATENT DOCUMENTS

EP 2663757 9/2015
WO 2007078269 7/2007
WO 2012159194 11/2012

OTHER PUBLICATIONS

International Search Report and Written Opinion from PCT Int'l. Application No. PCT/GB2016/053037 (Int'l Filing Date: Sep. 29, 2016) as completed on Dec. 16, 2016 and dated Dec. 23, 2016 (13 pages).

(Continued)

*Primary Examiner* — Mark A Laurenzi
*Assistant Examiner* — Shafiq Mian
(74) *Attorney, Agent, or Firm* — Andrew J. Anderson, Esq.; Alfred Y. Chu, Esq.; Harter Secrest & Emery LLP

(57) ABSTRACT

A power recovery system for recovering power from a working fluid, comprising a heat exchanger that is configured to receive a first stream of the working fluid, one or more expansion stages for expanding the working fluid to recover power from the working fluid, wherein one or more of the expansion stages is in fluid communication with the heat exchanger, wherein the heat exchanger is configured to transfer heat between the first stream of the working fluid and another stream of the working fluid that is received from one or more of the expansion stages.

30 Claims, 4 Drawing Sheets

(51) Int. Cl.

| | |
|---|---|
| ***F01K 7/16*** | (2006.01) |
| ***F01K 7/30*** | (2006.01) |
| *F01K 25/00* | (2006.01) |

(56) References Cited

U.S. PATENT DOCUMENTS

| | | | | |
|---|---|---|---|---|
| 6,301,927 | B1 * | 10/2001 | Reddy | F25J 3/0209 62/619 |
| 7,047,744 | B1 | 5/2006 | Robertson et al. | |
| 10,030,546 | B2 * | 7/2018 | Malinin | F01D 15/10 |
| 10,060,299 | B2 * | 8/2018 | Al Ghizzy | F01K 25/08 |
| 10,233,833 | B2 * | 3/2019 | Apte | F03G 6/04 |
| 2007/0108200 | A1 * | 5/2007 | McKinzie, II | C07C 4/02 219/770 |
| 2009/0241543 | A1 * | 10/2009 | Ernst | F01K 9/04 60/645 |
| 2010/0018207 | A1 * | 1/2010 | Juchymenko | F01K 23/065 60/670 |
| 2010/0326076 | A1 * | 12/2010 | Ast | F01K 23/04 60/671 |
| 2011/0203312 | A1 * | 8/2011 | Jakobsen | F25J 1/0022 62/613 |
| 2012/0060501 | A1 * | 3/2012 | Hemrle | F02C 1/10 60/645 |
| 2012/0067055 | A1 * | 3/2012 | Held | F02C 7/12 60/772 |
| 2012/0096869 | A1 * | 4/2012 | Kesseli | F02C 3/20 60/772 |
| 2012/0216520 | A1 * | 8/2012 | Chen | F03G 7/06 60/412 |
| 2012/0222423 | A1 * | 9/2012 | Mercangoez | F01K 3/006 60/645 |
| 2012/0255312 | A1 * | 10/2012 | Rajaraman | F01K 21/04 62/6 |
| 2014/0000261 | A1 | 1/2014 | Freund et al. | |
| 2014/0217739 | A1 | 8/2014 | Morgan et al. | |

OTHER PUBLICATIONS

GB Intellectual Property Office, Search Report from GB Patent Application No. GB1517213.3 dated Mar. 14, 2016 (2 pages).

* cited by examiner

HEAT RECOVERY

FIELD OF THE INVENTION

The present invention relates to an improved system and method for recovering power from a working fluid.

BACKGROUND OF THE INVENTION

The present invention relates to an improved system and method for heat recovery for power recovery cycles; in particular for use in thermodynamic energy storage devices being retro-fitted to existing thermal processes in order to optimise the balance between cost and performance within the constraints of the existing thermal process.

Electricity transmission and distribution networks (or grids) must balance the generation of electricity with demand from consumers. At present, this is normally achieved by modulating a generation side (supply side) of the network by turning power stations on and off and/or running some power stations at reduced load. As most existing thermal and nuclear power stations are most efficient when run continuously at full load, balancing the supply side in this way results in an efficiency penalty. Significant intermittent renewable generation capacity, for example using wind turbines and solar collectors, is currently being introduced to the networks, and this further complicates the balancing of the grids by creating uncertainty in the availability of portions of generation capacity.

Energy storage devices and systems typically have three phases of operation: charge, store and discharge. Energy storage devices typically generate power (discharge) on a highly intermittent basis when there is a shortage of generating capacity on the transmission and distribution network. This can be signalled to the storage device operator by a high price for electricity in the local power market or by a request from the organisation responsible for the operating of the network for additional capacity. In some countries, such as the United Kingdom, the network operator enters into contracts for the supply of back-up reserves to the network with operators of power plants with rapid start capability. Such contracts can cover months or even years, but typically the time during which the power provider will be operating (generating power) is very short. A storage device can provide an additional service in providing additional loads at times of oversupply of power to the grid from intermittent renewable generators. Wind speeds are often high overnight when demand is low. The network operator must either arrange for additional demand on the network to utilise the excess supply, through low energy price signals or specific contracts with consumers, or constrain the supply of power from other stations or the wind farms. In some cases, especially in markets where wind generators are subsidised, the network operator will have to pay the wind farm operators to 'turn off' the wind farm. A storage device offers the network operator a useful additional load that can be used to balance the grid in times of excess supply.

For a storage system or device to be commercially viable the following factors are important: capital cost per MW (power capacity), capital cost per MWh (energy capacity), round trip cycle efficiency and lifetime with respect to the number of charge and discharge cycles that can be expected from the initial investment. For widespread utility scale applications, it is also important that the storage device be geographically unconstrained, i.e. that it can be built anywhere; in particular next to a point of high demand or next to a source of intermittency or a bottleneck in the transmission and distribution network.

One such storage device technology is the storage of energy using a cryogen (Liquid Air Energy Storage (LAES)), such as liquid air or liquid nitrogen, which offers a number of advantages in the market place. Broadly speaking a LAES system would typically, in the charge phase, utilise low cost or surplus electricity, at periods of low demand or excess supply from intermittent renewable generators, to liquefy a working fluid such as air or nitrogen during a first liquefaction phase. This is then stored as a cryogenic fluid in a storage tank during a storage phase, and subsequently released to drive a turbine, producing electricity during a discharge, or power recovery, phase at periods of high demand or insufficient supply from intermittent renewable generators.

The power recovery turbine of a LAES system operates by drawing liquid air or nitrogen (liquid air from here on) from a low-pressure, thermally insulated cryogenic storage tank, pumping it to high pressure, heating it to form a gas at high pressure, and expanding it in a turbine or other expansion device to recover work, which can be transformed into electrical power using an electrical generator. As with any thermodynamic power cycle, a determining factor of the power that may be recovered is the difference between the high-temperature and low-temperature ends of the cycle. The larger the temperature difference, the more power can be extracted. The saturation temperature of liquid air at ambient pressure is approximately minus 190 degrees Celsius. Therefore, even heating the air to ambient temperature affords a significant output of power.

The power output of a LAES system, and therefore the round trip cycle efficiency, can be improved by utilising waste heat from a collocated process, for example from a thermal power plant or industrial process such as a steel works, to heat the liquid air to a higher temperature than ambient temperature. The term "collocated process" thus refers to a system collocated with and external to the LAES system. This definition applies whenever the terms collocated process, collocated thermal process or external process appear in this specification. From the point of view of the collocated process, the thermal efficiency of the collocated process is also improved.

EP2663757 describes a LAES power recovery system wherein the working fluid may be heated using waste heat from a collocated process. The system comprises one or more expansion stages. Waste heat is transferred from a different heat transfer fluid to the gaseous working fluid to heat it prior to expansion in each of the one or more expansion stages. A skilled person will recognise that the different heat transfer fluid may indeed be the source of waste heat itself, for example in the case of the exhaust gases of an engine.

One application for a LAES system is in conjunction with a peaking plant. Peaking plants typically operate for very short periods of time, for example a few hours per day, in order to respond to peaks in demand on the electrical grid. In the peaking application, a LAES system will charge by liquefying air during times of low demand, for example at night. The LAES system operates in power recovery phase simultaneously with a thermal peaking plant and recovers heat directly from the operation of said thermal peaking plant, to improve performance.

In a typical design for a LAES system integrated into an Open-Cycle Gas Turbine (OCGT) peaking plant, heat is recovered directly from the exhaust stack of the turbine. The LAES power recovery cycle comprises multiple stages of expansion with a reheat heat exchanger between each stage. The reheat heat exchangers are situated directly in the turbine exhaust stack.

FIG. 1 shows a known power recovery system 10. Liquid air is drawn from a cryogenic tank 100, pumped to 140 bar in a cryogenic pump 200 and evaporated in an evaporator 300 to form a gaseous, high-pressure working fluid at approximately ambient temperature (e.g. 15° C.). The cold recovered from the evaporator 300 may either be ejected to atmosphere or recovered in a cold storage system to be used later in the charge phase of the LAES system.

The high-pressure working fluid is then conveyed to a waste heat exchanger 401 which is thermally coupled to an exhaust stack of an Open-Cycle Gas Turbine. At waste heat exchanger 401, the high-pressure working fluid is heated in heat exchange with the exhaust gases of the OCGT to approximately 450° C.

The heated high-pressure working fluid is then conveyed to an expansion stage 501 (e.g. comprising an expander) where it is expanded to produce work. The exhaust working fluid from the expansion stage 501 is then conveyed to another heat exchanger 402 that is thermally coupled to the exhaust stack of the OCGT where it is reheated ready to be expanded again in another expansion stage 502. This process is then repeated as desired.

When building a new LAES system and integrated collocated thermal process, the thermal process and LAES plant are ideally located in close proximity to allow for easy transfer of heat from the thermal process to the LAES system. However, LAES is particularly suited to retro-fitting of existing thermal processes to improve their thermal efficiency and revenue generation. On existing sites, there are often significant space constraints. The space available for the construction of a LAES plant may be a significant distance away from the point at which the waste heat is available from the collocated thermal process. In this specification, the term "thermal process" refers to a thermal system.

According to the configuration shown in FIG. 1, this means that a significant length of pipework is required to convey the working fluid to and from the source of waste heat (in this case, the exhaust stack of the OCGT) between each stage of expansion. Long lengths of pipework incur significant cost, in the pipework itself, and in the supports and thermal insulation thereof. Furthermore, the pipework introduces higher pressure drops, which impact on the performance of the cycle. This can be mitigated by increasing the diameter of the pipework, as is known in the art, but this further increases cost.

An alternative known design is to transfer heat indirectly from the source of waste heat (e.g. the OCGT) to the LAES power recovery cycle using an intermediate loop with a heat transfer fluid such as water, thermal oil or a gas such as air or nitrogen. This allows the designer to use a single return to the source of waste heat, with one pipe to and one pipe from the waste heat source. However, such systems add thermal inertia and slow down the startup of the LAES system, which can be critical in meeting the requirements for services to the electrical grid.

For high temperatures, such as those available in the exhaust stack of an OCGT, water heat transfer fluid would need to be held at high pressure to avoid boiling. For example, to transfer heat at 275° C., water would have to be held at upwards of 60 bar. This incurs the significant material, engineering and maintenance costs associated with high-pressure systems and maintaining the pressure within the system. It would also need to be managed to avoid freezing, at further financial and energy cost. Oil-based systems also present a fire and pollution risk.

A gas-based system would be more energy intensive, requiring more power to recirculate the gas.

There is therefore a need to minimise system costs while maintaining the performance of the power recovery cycle for LAES installations using direct heat transfer with a distant source of waste heat.

SUMMARY OF THE INVENTION

The present inventors have discovered a heat recovery arrangement that addresses the problems described above. The arrangement utilises a high-pressure gaseous (e.g. air or nitrogen) working fluid to fulfil the function of an intermediate heat transfer fluid. For example, the working fluid may be used to transfer heat from a waste heat source (e.g. an exhaust) to the locality of the LAES power recovery system before it is used in a power recovery cycle.

In accordance with a first aspect of the invention, there is provided a power recovery system for recovering power from a working fluid, comprising:

- a heat exchanger that is configured to receive a first stream of the working fluid;
- one or more expansion stages for expanding the working fluid to recover power from the working fluid, wherein one or more of the expansion stages is in fluid communication with the heat exchanger,
- wherein the heat exchanger is configured to transfer heat between the first stream of the working fluid and another stream of the working fluid that is received from one or more of the expansion stages.

In other words, the heat exchanger is configured to transfer heat from the first stream of the working fluid to another stream of the working fluid that has been expanded in one or more of the expansion stages (i.e. exhaust from one or more of the expansion stages). In this way, the working fluid that has been expanded in one or more of the expansion stages is heated to a sufficiently high temperature that it can be expanded again. Thus, the working fluid is used in place of a conventional intermediate heat transfer fluid to transfer heat between the first stream of the working fluid and another stream of the working fluid at another location within the power recovery system.

The heat exchanger may be configured to transfer heat from the first stream of the working fluid to another stream of the working fluid that is received from one or more of the expansion stages. The heat that is transferred by the heat exchanger may be recovered by cooling the first stream of the working fluid.

The working fluid may be a gaseous working fluid, such as air or nitrogen.

Each expansion stage may comprise an expander for expanding the working fluid to recover power.

The heat exchanger may be configured to receive the first stream of the working fluid from a working fluid input. The working fluid input may comprise:

- a source of a liquid;
- a pump for pumping the liquid to a high pressure; and
- an evaporator for evaporating the liquid to form the gaseous working fluid.

The source of a liquid may comprise a liquid storage tank or a condenser for producing the liquid from a gas. The liquid may comprise a cryogen, such as liquid air or liquid nitrogen.

The heat exchanger may be configured to receive the first stream of the working fluid from another heat exchanger or an expansion stage.

The system may further comprise a waste heat recovery apparatus for recovering heat from an external process and using the recovered heat to heat the first stream of the working fluid before the first stream of the working fluid is transported to the heat exchanger. As mentioned in page 3 of this specification, the term "external process" refers to a system collocated with and external to the LAES system. The waste heat recovery apparatus may comprise one or more waste heat exchangers. The waste heat recovery apparatus may be for recovering waste heat from an external process, such as an Open-Cycle Gas Turbine (OCGT). The waste heat recovery apparatus may be for recovering waste heat from hot gas in an external process, such as from an exhaust of the external process.

The waste heat recovery apparatus may be configured to heat the first stream of the working fluid to a temperature that is higher than an inlet temperature of a first expansion stage. A first heat exchanger is configured to cool the first stream of the working fluid to an inlet temperature of a first expansion stage prior to the first stream of the working fluid being expanded in the first expansion stage.

The first heat exchanger may be configured to transfer heat between the first stream of the working fluid and a second stream of the working fluid that is received from one or more of the expansion stages. For example, the first expansion stage may be configured to return expanded working fluid to the first heat exchanger as a second stream of the working fluid.

The first heat exchanger may be configured to transfer heat from the first stream of the working fluid to the second stream of the working fluid and output the heated second stream of the working fluid as a third stream of the working fluid. The system may further comprise a second expansion stage that is configured to receive the third stream of the working fluid and expand the third stream of the working fluid to recover power from the third stream of the working fluid.

In other words, the working fluid may be cooled by the first heat exchanger prior to its expansion to recover power, such that some of its heat (e.g. excess heat from a waste heat source) can be transferred to a different point in the cycle, such as a second stream of the working fluid. The heat recovered from cooling the first stream of working fluid from the temperature of the waste heat source (e.g. OCGT) to the inlet temperature of the first expansion stage is transferred to a second stream of working fluid elsewhere in the power recovery system.

Thus, the invention can be used to exploit the fact that, in many cases, waste heat from an external or collocated thermal process is available at a higher temperature than is economic to exploit in the LAES system. For example, in an OCGT, the temperature of the exhaust is often available at approximately 450° C. In some instances, above approximately 300° C., turbomachinery used in an LAES power recovery system must be built of specialist materials that are expensive to procure and to machine. Since capital cost is of key importance for the financial viability of energy storage systems, it is often preferable to sacrifice the extra power output available from higher temperature reheating for a cheaper system using non-specialist machinery. The invention provides an advantageous solution providing a desired power recovery cheaply.

The invention provides a system and method for recovering heat and transferring heat within a power recovery system or a power recovery cycle at reduced material cost. The method and system of the invention provide the advantage of reduced material cost over methods and systems known in the art, especially when the turbomachinery of the power recovery cycle is far from the location where heat is available.

The invention therefore provides a means to move heat within the power recovery system without the need for an intermediate heat transfer fluid. The advantage of this arrangement is that working fluid may be conveyed fewer times to and from a waste heat recovery apparatus. This results in improved performance and, crucially, reduced pipework costs.

The system may further comprise a second heat exchanger that is configured to cool the third stream of the working fluid to an inlet temperature of a second expansion stage prior to the third stream of the working fluid being expanded in the second expansion stage. The second heat exchanger may be configured to transfer heat from the third stream of the working fluid to another stream of the working fluid to be transported to one or more of the expansion stages. The second expansion stage may be configured to return expanded working fluid to the second heat exchanger as a fourth stream of working fluid. The second heat exchanger may be configured to transfer heat from the third stream of the working fluid to the fourth stream of the working fluid and output the heated fourth stream of the working fluid as a fifth stream of the working fluid.

At least one heat exchanger and/or at least one expansion stage may be configured to return working fluid to the waste recovery apparatus so that the working fluid can be reheated before further expansion and/or heat exchange.

The system may comprise at least one valve configured to control a bypass flow of the working fluid to bypass at least one heat exchanger to control the temperature of the stream of the working fluid exiting said heat exchanger.

The working fluid may be produced from a cryogen, such as liquid air or liquid nitrogen.

In accordance with another aspect of the invention, there is provided a method of using a working fluid within a power recovery system comprising:

- providing a heat exchanger within the power recovery system with a first stream of the working fluid; and
- using the heat exchanger to transfer heat between the first stream of the working fluid and a second stream of the working fluid that is received from one or more of the expansion stages.

The method may comprise using the heat exchanger to transfer heat from the first stream of the working fluid to the second stream of the working fluid. The method may comprise cooling the first stream of the working fluid to recover the heat to transfer to the second stream of the working fluid and expanding the first stream of the working fluid in a first expansion stage to recover power from the first stream of the working fluid. The method may further comprise returning the expanded first stream of the working fluid to the heat exchanger as a second stream of the working fluid. The method may further comprise outputting the heated second stream of the working fluid from the heat exchanger as a third stream of the working fluid.

The working fluid may be a gaseous working fluid, such as air or nitrogen.

The method may further comprise using a waste heat recovery apparatus to recover heat from an external process and using the recovered heat to heat the first stream of the working fluid before the first stream of the working fluid is transported to the heat exchanger. The waste heat recovery apparatus may comprise one or more waste heat exchangers. The waste heat recovery apparatus may recover waste heat from an external process. The waste heat recovery apparatus may recover waste heat from hot gas in an external process, such as from an exhaust of an external process The waste heat recovery apparatus may heat the first stream of working fluid to a temperature that is higher than an inlet temperature of a first expansion stage.

The method may further comprise returning working fluid from at least one heat exchanger and/or at least one expansion stage to the waste recovery apparatus so that the working fluid can be reheated before further expansion and/or heat exchange.

The working fluid may be produced by evaporating a liquid to form a gas and pumping the gas to a high pressure. The working fluid may be produced from a cryogen, such as liquid air or liquid nitrogen.

Whilst cryogenic energy storage systems and methods are mentioned herein, the principles of the invention apply to any power recovery systems involving multi-stage expansion of a hot gas when the heat is supplied from a heat source which may either be within (thus belong to) or be (external to and) nearby said power recovery systems. The heat supplied by the heat source may comprise one element or a combination of the elements of the following list: waste heat, ambient heat, intentionally-produced heat, heat stored in one or a plurality of thermal stores.

The term intentionally-produced heat refers to any heat produced specifically to heat the working fluid circulating within the power recovery systems prior to each expansion stage. Waste heat may comprise one element or a combination of the elements of the following list: heat produced by power plants (such as nuclear, fossil fuel-based, biofuel-based or solar power plants), heat produced by data centres, heat produced by manufacturing plants (using kilns, ovens or exothermic chemical reactions).

Intentionally-produced heat may comprise one element or a combination of the elements of the following list: concentration solar collector, combustor, load bank.

The heat source may be one thermal store or a plurality of thermal stores, or may comprise at least one thermal store.

The power recovery systems in question may comprise one element or a combination of the elements of the following list: Rankine cycle, Brayton cycle.

BRIEF DESCRIPTION OF THE DRAWINGS

The present invention will now be described with reference to the accompanying drawings, in which.

DETAILED DESCRIPTION OF THE DRAWINGS

In embodiments of the present invention, the power recovery system utilises a working fluid. The working fluid is transported around the power recovery system, such that various streams (e.g. first, second, third, etc.) form a flow path around the power recovery system. It will be understood that any denomination of first, second, third, etc. expansion stages is not necessarily intended to indicate an order in terms of the flow of working fluid. For example, a 'second' expansion stage may be upstream of a 'first' expansion stage.

Whilst cryogenic energy storage systems and methods are mentioned herein, the principles of the invention apply to any any power recovery systems involving multi-stage expansion of a hot gas when the heat is supplied from a heat source which may either be within (thus belong to) or be (external to and) nearby said power recovery systems. The heat supplied by the heat source may comprise one element or a combination of the elements of the following list: waste heat, ambient heat, intentionally-produced heat, heat stored in one or a plurality of thermal stores.

The term intentionally-produced heat refers to any heat produced specifically to heat the working fluid circulating within the power recovery systems prior to each expansion stage. Waste heat may comprise one element or a combination of the elements of the following list: heat produced by power plants (such as nuclear, fossil fuel-based, biofuel-based or solar power plants), heat produced by data centres, heat produced by manufacturing plants (using kilns, ovens or exothermic chemical reactions).

Intentionally-produced heat may comprise one element or a combination of the elements of the following list: concentration solar collector, combustor, load bank.

The heat source may be one thermal store or a plurality of thermal stores, or may comprise at least one thermal store.

The power recovery systems in question may comprise one element or a combination of the elements of the following list: Rankinecycle, Brayton cycle.

In all drawings, the circle labelled with a 'G' represents an electrical generator.

Figure 2:
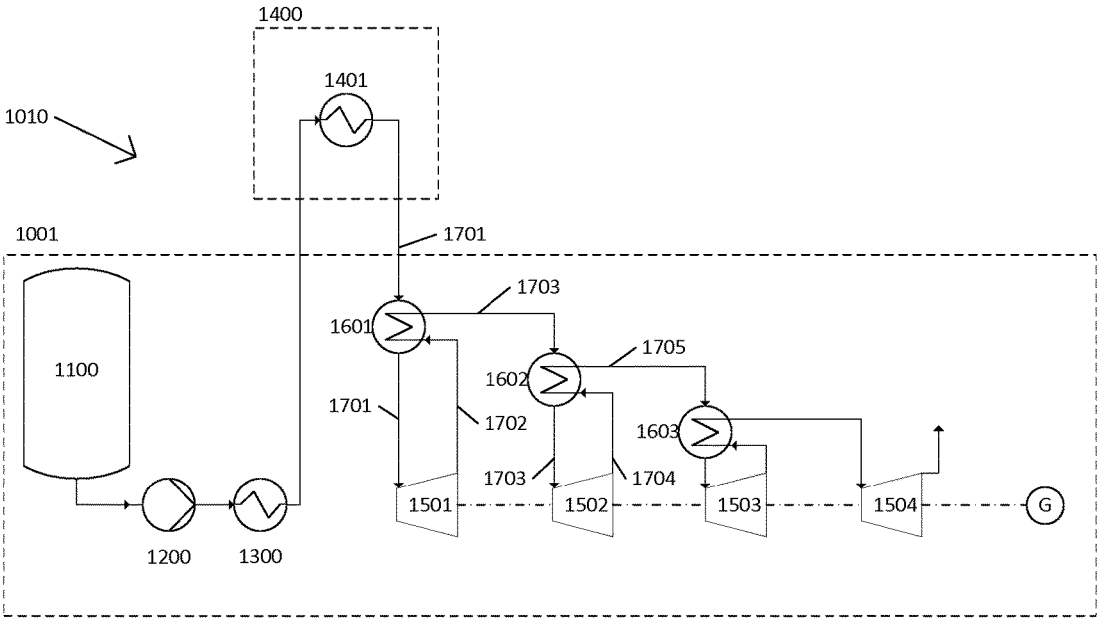
FIG. 2 shows a power recovery system according to a first embodiment of the present invention.

FIG. 2 shows a power recovery system 1010 according to a first embodiment of the present invention. The system is designed to recover power from a working fluid, such as a gaseous working fluid (e.g. air). The system 1010 comprises one or more heat exchangers that are configured to receive a first stream of the working fluid, and transfer heat between the first stream of the working fluid and another stream of the working fluid at another location within the power recovery system. The system also comprises one or more expansion stages for expanding the working fluid to recover power from the working fluid. One or more of the expansion stages is in fluid communication with one or more of the heat exchanger(s).

In particular, the system 1010 comprises first 1601, second 1602 and third 1603 heat exchangers and first 1501, second 1502, third 1503 and fourth 1504 expansion stages. Each expansion stage comprises an expander for expanding working fluid to recover power. Whilst three heat exchangers and four expansion stages are shown in FIG. 2, the skilled person will understand that any suitable number of heat exchangers and expansion stages can be used.

The system 1010 comprises a cryogenic liquid storage tank 1100 for storing a cryogenic liquid, such as liquid air, a pump (e.g. a cryogenic pump) 1200 and an evaporator 1300. The skilled person will understand that any source of liquid, such as a condenser for producing a liquid from a gas, could be used instead of, or in addition to, the tank 1100. Liquid air is drawn from the tank 1100, pumped to a high-pressure (e.g. 140 bar) by the pump 1200, and evaporated in the evaporator 1300 to form a gaseous high-pressure working fluid at approximately ambient temperature (e.g. 15° C.). The cold recovered from the evaporator 1300 may either be ejected to atmosphere or recovered in a cold storage system (not shown) to be used later in a charge phase of a LAES system.

The system 1010 further comprises a waste heat recovery apparatus 1400 for recovering heat from an external process and using the recovered heat to heat a stream of the working fluid before the stream of the working fluid is transported to a heat exchanger. The waste heat recovery apparatus 1400 is typically configured to heat the stream of the working fluid to a temperature that is higher than an inlet temperature of an expansion stage. A heat exchanger can then be used to cool the stream of the working fluid to the inlet temperature of the expansion stage prior to the stream of the working fluid being expanded in the expansion stage.

In the system shown in FIG. 2, the waste heat recovery apparatus 1400 comprises a first 1401 waste heat exchanger that is thermally coupled to a waste heat source, such as an exhaust stack of an Open-Cycle Gas Turbine (OCGT—not shown). Whilst one waste heat exchanger is shown in FIG. 2, the skilled person will understand that any suitable number of waste heat exchangers can be used.

The high-pressure working fluid is conveyed e.g. at 140 bar from the evaporator 1300 to the first waste heat exchanger 1401 where it is heated in heat exchange with the exhaust gases of the OCGT to a high temperature, for example to approximately 450° C.

The first heat exchanger 1601 is configured to receive a first stream 1701 of the working fluid. In the system 1010 shown in FIG. 2, the first heat exchanger 1601 is configured to receive the first stream 1701 of the working fluid from the first waste heat exchanger 1401, and to transfer heat from the first stream 1701 of the working fluid to another stream of the working fluid elsewhere in the power recovery system 1010. The heat that is transferred by the heat exchanger is typically recovered by cooling the first stream 1701 of the working fluid. In alternative embodiments, the first heat exchanger may receive the first stream of the working fluid from another heat exchanger or an expansion stage. The cooled first stream 1701 of the working fluid is then expanded in the first expansion stage 1501 to produce work.

The first heat exchanger 1601 is configured to transfer heat from the first stream 1701 of the working fluid to a second stream 1702 of the working fluid and output the heated second stream 1702 of the working fluid as a third stream 1703 of the working fluid. The system further comprises a second expansion stage 1502 that is configured to receive the third stream 1703 of the working fluid and expand the third stream 1703 of the working fluid to recover power from the third stream 1703 of the working fluid In an exemplary embodiment, the heated high-pressure working fluid (the first stream 1701) is conveyed from the first waste heat exchanger 1401 to the first heat exchanger 1601 where it is cooled to a suitable input temperature of the first expansion stage 1501 (typically approximately 275° C.) before being expanded in the first expansion stage 1501 to produce work. The first expansion stage 1501 is configured to return the expanded working fluid to the first heat exchanger 1601 as a second stream 1702 of the working fluid. The first heat exchanger 1601 is configured to transfer heat from the first stream 1701 of the working fluid (i.e. the working fluid received from the first waste heat exchanger 1401) to the second stream 1702 of the working fluid (i.e. the working fluid received from the first expansion stage 1501) and output the heated second stream of the working fluid as a third stream 1703 of the working fluid.

In particular, in one embodiment, the second stream 1702 of the working fluid (i.e. exhaust from the first expansion stage 1501) emerges from the first expansion stage 1501 at approximately 160° C. and 45 bar and is heated to approximately 340° C. in the first heat exchanger 1601 in heat exchange with the working fluid received from the first waste heat exchanger 1401.

As described previously, the system 1010 further comprises a second heat exchanger 1602 and a second expansion stage 1502. The second heat exchanger 1602 is configured to cool the third stream 1703 of the working fluid to an inlet temperature of the second expansion stage 1502 prior to the third stream 1703 of the working fluid being expanded in the second expansion stage 1502. In a similar manner to the first expansion stage 1501, the second expansion stage 1502 is configured to return expanded working fluid (i.e. expanded working fluid from the third stream 1703) to the second heat exchanger 1502 as a fourth stream 1704 of working fluid. The second heat exchanger 1502 is then configured to transfer heat from the third stream 1703 of the working fluid to the fourth stream 1704 of the working fluid and output the heated fourth stream 1704 of the working fluid as a fifth stream 1705 of the working fluid.

In particular, in one embodiment, the third stream 1703 of the working fluid is cooled in the second heat exchanger 1602 to 275° C. before being expanded in the second expansion stage 1502. The expanded third stream 1703 of the working fluid emerges at approximately 150° C. and 15 bar as the fourth stream 1704 of the working fluid. The fourth stream 1704 of the working fluid is then reheated in the second heat exchanger 1602 to approximately 220° C. using heat recovered from the third stream 1703 of the working fluid.

This process is then repeated as desired. As described previously, the system 1010 shown in FIG. 2 further comprises a third heat exchanger 1603 and third 1503 and fourth 1504 expansion stages. The fifth stream 1705 of the working fluid that is output by the second heat exchanger 1602 is cooled (e.g. to 200° C.) in the third heat exchanger 1603 and expanded in third expansion stage 1503. Working fluid emerges from the exhaust of the third expansion stage 1503 (e.g. at approximately 75° C. and 4 bar) and is reheated (e.g. to 94° C.) in the third heat exchanger 1603 before being expanded in the fourth expansion stage 1504 and exhausted to atmosphere.

A person skilled in the art will recognise that if the exhaust (i.e. waste heat) of the OCGT is at a high enough temperature, for example 650° C., the first stream 1701 of the working fluid may be heated to a high enough temperature in the first waste heat exchanger 1401 to provide sufficient heat to reheat all stages to 275° C. (i.e. a suitable input temperature of one or more of the expansion stages).

Whilst first 1601, second 1602 and third 1603 heat exchangers have been described, it will be understood that each of these heat exchangers is configured to transfer heat between a first stream of the working fluid and another stream of the working fluid that is received from one or more of the expansion stages. Thus, any of the heat exchangers 1601, 1602 and 1603 can be a heat exchanger (or a first heat exchanger) within the meaning of the present invention.

Figure 3:
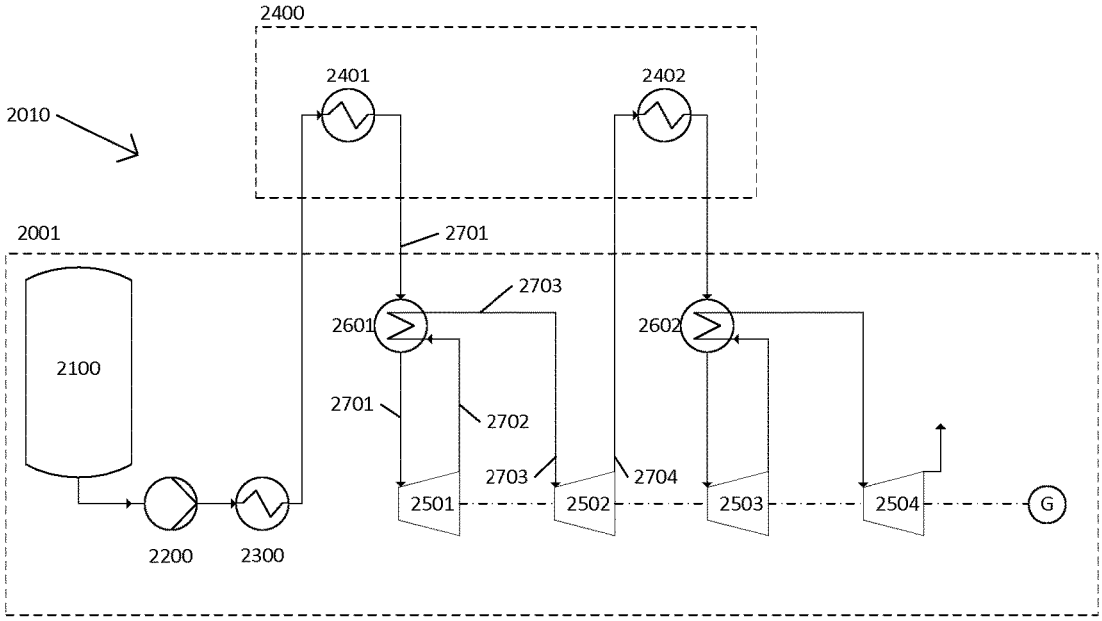
FIG. 3 shows a power recovery system according to a second embodiment of the present invention.

FIG. 3 shows a system 2010 according to a second embodiment of the present invention. The system 2010 comprises one or more heat exchangers that are configured to receive a first stream of the working fluid, and transfer heat between the first stream of the working fluid and another stream of the working fluid at another location within the power recovery system. The system also comprises one or more expansion stages for expanding the working fluid to recover power from the working fluid. One or more of the expansion stages is in fluid communication with the heat exchanger.

The system 2010 shown in FIG. 3 is like the system 1010 shown in FIG. 2 except that the second heat exchanger 1602 of FIG. 2 is replaced with a second waste heat exchanger 2402, which is situated in the waste heat recovery apparatus 2400.

In particular, the system 2010 comprises first 2601 and second 2602 heat exchangers and first 2501, second 2502, third 2503 and fourth 2504 expansion stages. Each expansion stage comprises an expander for expanding working fluid to recover power. Whilst two heat exchangers and four expansion stages are shown in FIG. 3, the skilled person will understand that any suitable number of heat exchangers and expansion stages can be used.

Like the system 1010 shown in FIG. 2, the system 2010 comprises a cryogenic liquid storage tank 2100 for storing a cryogenic liquid, such as liquid air, a pump (e.g. a cryogenic pump) 2200 and an evaporator 2300. The skilled person will understand that any source of liquid, such as a condenser for producing a liquid from a gas, could be used instead of, or in addition to, the tank 2100. Liquid air is drawn from the tank 2100, pumped to a high-pressure (e.g. 140 bar) by the pump 2200, and evaporated in the evaporator 2300 to form a gaseous high-pressure working fluid at approximately ambient temperature (e.g. 15° C.). The cold recovered from the evaporator 2300 may either be ejected to atmosphere or recovered in a cold storage system (not shown) to be used later in a charge phase of a LAES system.

Like the system 1010 shown in FIG. 2, the system 2010 further comprises a waste heat recovery apparatus 2400 for recovering heat from an external process and using the recovered heat to heat a stream of the working fluid before the stream of the working fluid is transported to a heat exchanger. The waste heat recovery apparatus 2400 is typically configured to heat the stream of the working fluid to a temperature that is higher than an inlet temperature of an expansion stage. A heat exchanger can then be used to cool the stream of the working fluid to the inlet temperature of the expansion stage prior to the stream of the working fluid being expanded in the expansion stage.

In the system shown in FIG. 3, the waste heat recovery apparatus 2400 comprises first 2401 and second 2402 waste heat exchangers that are thermally coupled to a waste heat source, such as an exhaust stack of an Open-Cycle Gas Turbine (OCGT—not shown). Whilst two waste heat exchangers are shown in FIG. 3, the skilled person will understand that any suitable number of waste heat exchangers can be used.

The high-pressure working fluid is conveyed from the evaporator 2300 to the first waste heat exchanger 2401 where it is heated in heat exchange with the exhaust gases of the OCGT to a high temperature, typically approximately 450° C.

The first heat exchanger 2601 is configured to receive a first stream 2701 of the working fluid. In the system 2010 shown in FIG. 3, the first heat exchanger 2601 is configured to receive the first stream 2701 of the working fluid from the first waste heat exchanger 2401, and to transfer heat from the first stream 2701 of the working fluid to another stream of the working fluid elsewhere in the power recovery system 2010. The heat that is transferred by the heat exchanger is recovered by cooling the first stream 2701 of the working fluid. The cooled first stream 2701 of the working fluid is then expanded in the first expansion stage 2501 to produce work.

In alternative embodiments, the first heat exchanger may receive the first stream of the working fluid from another heat exchanger or an expansion stage.

In particular, the first heat exchanger 2601 is configured to transfer heat from the first stream 2701 of the working fluid to a second stream 2702 of the working fluid and output the heated second stream 2702 of the working fluid as a third stream 2703 of the working fluid. The system further comprises a second expansion stage 2502 that is configured to receive the third stream 2703 of the working fluid and expand the third stream 2703 of the working fluid to recover power from the third stream 2703 of the working fluid.

In an exemplary embodiment, the heated high-pressure working fluid (the first stream 2701) is conveyed from the first waste heat exchanger 2401 to the first heat exchanger 2601 where it is cooled to a suitable input temperature of the first expansion stage 2501 (typically approximately 275° C.) before being expanded in the first expansion stage 2501 to produce work. The first expansion stage 2501 is configured to return the expanded working fluid to the first heat exchanger 2601 as a second stream 2702 of the working fluid. The first heat exchanger 2601 is configured to transfer heat from the first stream 2701 of the working fluid (i.e. the working fluid received from the first waste heat exchanger 2401) to the second stream 2702 of the working fluid (i.e. the working fluid received from the first expansion stage 2501) and output the heated second stream of the working fluid as a third stream 2703 of the working fluid.

In particular, in one embodiment, the second stream 2702 of the working fluid (i.e. exhaust from the first expansion stage 2501) emerges from the first expansion stage 2501 at approximately 160° C. and 45 bar and is heated to approximately 340° C. in the first heat exchanger 2601 in heat exchange with the working fluid received from the first waste heat exchanger 2401.

As described previously, the system 2010 further comprises a second expansion stage 2502. The third stream 2703 of the working fluid is expanded in the second expansion stage 2502 to recover power from the third stream 2703 of the working fluid. The second expansion stage 2502 is configured to return expanded working fluid (i.e. expanded working fluid from the third stream 2703) to the second waste heat exchanger 2402 in the waste heat recovery apparatus 2400 as a fourth stream 2704 of the working fluid so that the fourth stream 2704 of the working fluid can be reheated by the second waste heat exchanger 2402 (e.g. to approximately 410° C.). The working fluid that is reheated in the second waste heat exchanger 2402 is then conveyed to the second heat exchanger 2602 where it is cooled (e.g. to 275° C.) before being expanded in the third expansion stage 2503. The exhaust from the third expansion stage 2503 emerges (e.g. at approximately 130° C.) and is heated in the second heat exchanger 2602 (e.g. to 275° C.) before being expanded in the fourth expansion stage 2504 and exhausted to atmosphere.

Whilst first 2601 and second 2602 heat exchangers have been described, it will be understood that both of these heat exchangers are configured to transfer heat between a first stream of the working fluid and another stream of the working fluid that is received from one or more of the expansion stages. Thus, any of the heat exchangers 1601 and 1602 can be a heat exchanger (or a first heat exchanger) within the meaning of the present invention.

Figure 1:
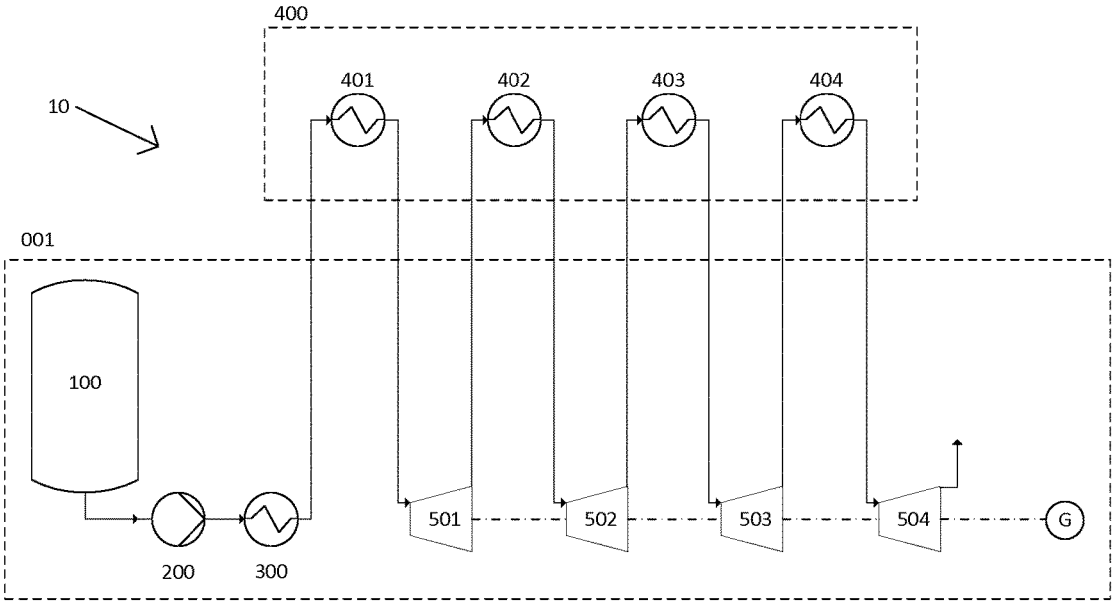
FIG. 1 shows a known power recovery system.

The system 2010 provides for increased performance over the system 1010 due to the higher inlet temperatures of the third and fourth expansion stages. However, it is more costly due to the second return trip to the waste heat recovery unit. It is nevertheless less costly than existing systems, such as the system 10 shown in FIG. 1. In other words, the system 2010 provides an advantageous solution of high performance at a low cost.

Figure 4:
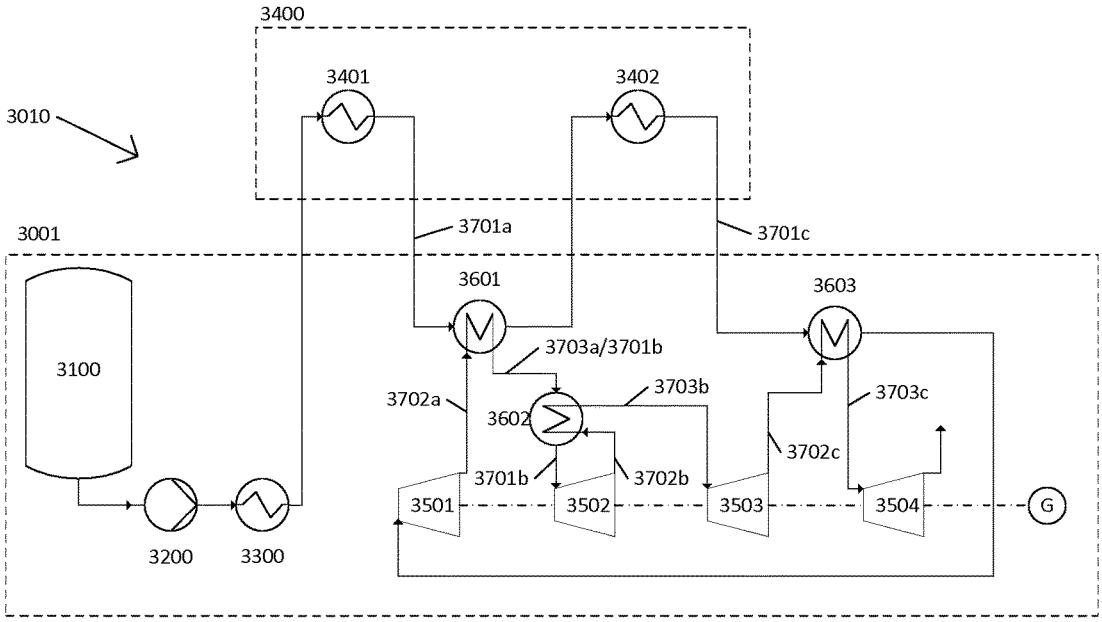
FIG. 4 shows a power recovery system according to a third embodiment of the present invention.

FIG. 4 shows a system 3010 according to a third embodiment of the present invention. The system 3010 comprises one or more heat exchangers that are configured to receive a first stream of the working fluid, and transfer heat between the first stream of the working fluid and another stream of the working fluid at another location within the power recovery system. The system also comprises one or more expansion stages for expanding the working fluid to recover power from the working fluid. One or more of the expansion stages is in fluid communication with one or more of the heat exchanger(s).

In particular, the system 3010 comprises first 3601, second 3602 and third 3603 heat exchangers and first 3501, second 3502, third 3503 and fourth 3504 expansion stages. Each expansion stage comprises an expander for expanding working fluid to recover power. Whilst three heat exchangers and four expansion stages are shown in FIG. 4, the skilled person will understand that any suitable number of heat exchangers and expansion stages can be used.

Like the systems 1010 and 2010 shown in FIGS. 2 and 3, respectively, the system 3010 comprises a cryogenic liquid storage tank 3100 for storing a cryogenic liquid, such as liquid air, a pump (e.g. a cryogenic pump) 3200 and an evaporator 3300. The skilled person will understand that any source of liquid, such as a condenser for producing a liquid from a gas, could be used instead of, or in addition to, the tank 3100. Liquid air is drawn from the tank 3100, pumped to a high-pressure (e.g. 140 bar) by the pump 3200, and evaporated in the evaporator 3300 to form a gaseous high-pressure working fluid at approximately ambient temperature (e.g. 15° C.). The cold recovered from the evaporator 3300 may either be ejected to atmosphere or recovered in a cold storage system (not shown) to be used later in a charge phase of a LAES system.

Like the systems 1010 and 2010 shown in FIGS. 2 and 3, respectively, the system 3010 further comprises a waste heat recovery apparatus 3400 for recovering heat from an external process and using the recovered heat to heat a stream of the working fluid before the stream of the working fluid is transported to a heat exchanger. The waste heat recovery apparatus 3400 is typically configured to heat the stream of the working fluid to a temperature that is higher than an inlet temperature of an expansion stage. A heat exchanger can then be used to cool the stream of the working fluid to the inlet temperature of the expansion stage prior to the stream of the working fluid being expanded in the expansion stage.

In the system shown in FIG. 4, the waste heat recovery apparatus 3400 comprises first 3401 and second 3402 waste heat exchangers that are thermally coupled to a waste heat source, such as an exhaust stack of an Open-Cycle Gas Turbine (OCGT—not shown). Whilst two waste heat exchangers are shown in FIG. 4, the skilled person will understand that any suitable number of waste heat exchangers can be used.

In the system shown in FIG. 4, each of the first 3601, second 3602 and third 3603 heat exchangers is configured to receive a first stream of the working fluid, and transfer heat between the first stream of the working fluid and a second stream of the working fluid at another location within the power recovery system. Furthermore, the heat that is transferred by the first 3601, second 3602 and third 3603 heat exchangers is typically recovered by cooling the first stream of the working fluid and transferring heat recovered from the cooling to the second stream of the working fluid. Additionally, each of the first 3601, second 3602 and third 3603 heat exchangers is configured to transfer heat from the first stream of the working fluid to the second stream of the working fluid and output the heated second stream of the working fluid as a third stream of the working fluid.

In the arrangement shown in FIG. 4, the first heat exchanger 3601 is configured to receive a first stream 3701*a* of the working fluid from the first waste heat exchanger 3401, and to transfer heat from this first stream 3701*a* of the working fluid to a second stream 3702*a* of the working fluid received from the third heat exchanger 3603 via the first expansion stage 3501. The first heat exchanger 3601 then outputs a third stream 3703*a* of the working fluid.

Similarly, the second heat exchanger 3602 is configured to receive a first stream 3701*b* of the working fluid from the first heat exchanger 3601, and to transfer heat from this first stream 3701*b* of the working fluid to a second stream 3702*b* of the working fluid received from the second expansion stage 3502. The second heat exchanger 3602 then outputs a third stream 3703*b* of the working fluid.

Similarly, the third heat exchanger 3603 is configured to receive a first stream 3701*c* of the working fluid from the second waste heat exchanger 3402, and to transfer heat from this first stream 3701*c* of the working fluid to a second stream 3702*c* of the working fluid received from the third expansion stage 3503. The third heat exchanger 3603 then outputs a third stream 3703*c* of the working fluid.

Thus, each of the first 3601, second 3602 and third 3603 heat exchangers shown in FIG. 4 applies the advantageous principles of the present invention.

In the system shown in FIG. 4, high-pressure working fluid is conveyed from the evaporator 3300 to the first waste heat exchanger 3401 where it is heated in heat exchange with the exhaust gases of the OCGT to a high temperature, typically approximately 450° C.

The heated high-pressure working fluid is then conveyed to the first heat exchanger 3601 as first stream 3701*a* where it is cooled (e.g. to approximately 220° C.) before being conveyed back to the waste heat recovery apparatus 3400 where it is heated (e.g. to approximately 410° C.) in the second waste heat exchanger 3402. The heated working fluid exiting from the second waste heat exchanger 3402 is conveyed to the third heat exchanger 3603 as first stream 3701*c* where it is cooled (e.g. to 275° C.) before being expanded in first expansion stage 3501 to produce work. The exhaust from the first expansion stage 3501 emerges (e.g. at approximately 160° C. and 45 bar) as second stream 3702*a* and is heated (e.g. to approximately 390° C.) in the first heat exchanger 3601 in heat exchange with the first stream 3701*a* of the working fluid received from the first waste heat exchanger 3401. The first heat exchanger 3601 then outputs third stream 3703*a* of the working fluid.

The third stream 3703*a* (or first stream 3701*b*) of the working fluid is then cooled in the second heat exchanger 3602 (e.g. to 275° C.) before being expanded in the second expansion stage 3502, emerging as second stream 3702*b* of working fluid, for example at approximately 150° C. and 15 bar. The second stream 3702*b* of the working fluid is then reheated in the second heat exchanger 3602 (e.g. to approximately 275° C.) using heat from the first stream 3701*b* of the working fluid before being output as the third stream 3703*b* and expanded in the third expansion stage 3503. The exhaust from the third expansion stage 3503 emerges (e.g. at approximately 130° C. and 4 bar) as the second stream 3702*c* of the working fluid and is reheated (e.g. to approximately 275° C.) in the third heat exchanger 3603 using heat recovered from the first stream 3701*c* of the working fluid before emerging as third stream 3703*c*, being expanded in fourth expansion stage 3504 and exhausted to atmosphere.

Similarly to system 2010, system 3010 provides for increased performance over system 1010 due to the higher inlet temperatures on the third and fourth expansion stages. System 3010 is more costly then system 1010 due to the second return trip to the waste heat recovery apparatus. System 3010 may nevertheless be less costly than system 2010 as the working fluid is typically conveyed to the waste heat recovery apparatus at approximately 140 bar (i.e. a higher pressure), which requires a smaller pipe diameter. While the pipework must withstand higher pressure, the cost may be less than a lower pressure, larger diameter pipe. In other words, the system 3010 provides an advantageous solution of high performance at a low cost.

Figure 5:
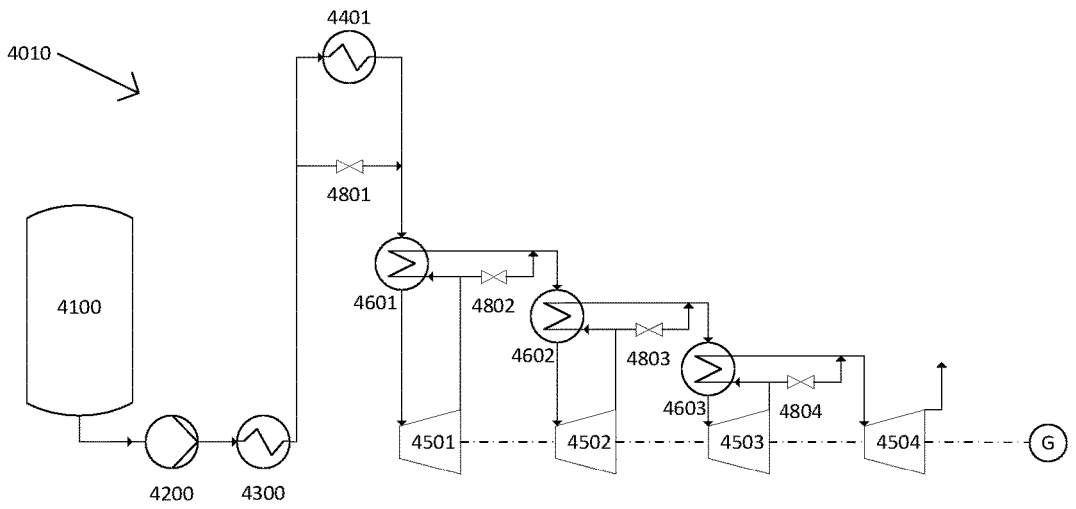
FIG. 5 shows a power recovery system according to a fourth embodiment of the present invention.

FIG. 5 shows a system 4010 according to a fourth embodiment of the present invention. The system comprises first 4601, second 4602 and third 4603 heat exchangers and first 4501, second 4502, third 4503 and fourth 4504 expansion stages. The system 4010 also comprises a cryogenic liquid storage tank 4100 for storing a cryogenic liquid, such as liquid air, a pump (e.g. a cryogenic pump) 4200 and an evaporator 4300. The skilled person will understand that any source of liquid, such as a condenser for producing a liquid from a gas, could be used instead of, or in addition to, the tank 4100. Additionally, the system 4010 comprises a waste heat recovery apparatus 4400 comprising a first 4401 waste heat exchanger that is thermally coupled to a waste heat source, such as an exhaust stack of an Open-Cycle Gas Turbine (OCGT—not shown).

The system 4010 shown in FIG. 5 operates in the same way as the system 1010 shown in FIG. 2, but with the addition of control valves 4801, 4802, 4803 and 4804, which allow the temperatures of the streams emerging from the waste heat exchanger 4401 and the heat exchangers 4601, 4602 and 4603 to be controlled by bypassing the heat exchangers with a portion of the flow on the cold side of the exchanger.

Figure 6:
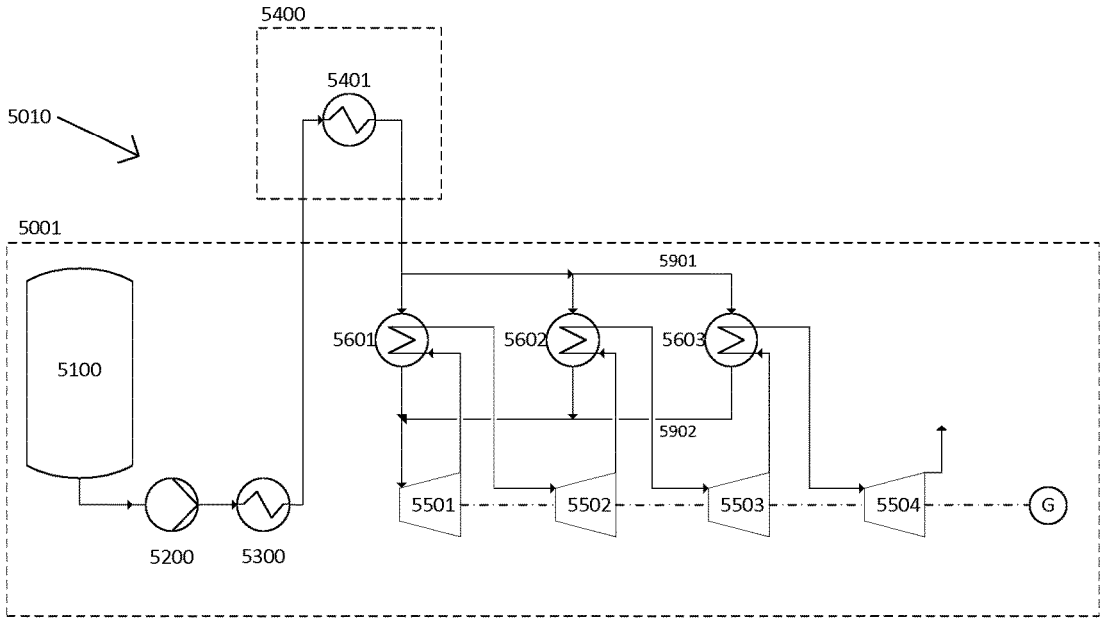
FIG. 6 shows a power recovery system according to a fifth embodiment of the present invention.

FIG. 6 shows a system 5010 according to a fifth embodiment of the present invention. The system comprises first 5601, second 5602 and third 5603 heat exchangers and first 5501, second 5502, third 5503 and fourth 5504 expansion stages. The system 5010 also comprises a cryogenic liquid storage tank 5100 for storing a cryogenic liquid, such as liquid air, a pump (e.g. a cryogenic pump) 5200 and an evaporator 5300. The skilled person will understand that any source of liquid, such as a condenser for producing a liquid from a gas, could be used instead of, or in addition to, the tank 5100. Additionally, the system 5010 comprises a waste heat recovery apparatus 5400 comprising a first 5401 waste heat exchanger that is thermally coupled to a waste heat source, such as an exhaust stack of an Open-Cycle Gas Turbine (OCGT—not shown).

The system 5010 shown in FIG. 6 operates in the same way as the system 1010 shown in FIG. 2, but differs in the working fluid can be shared between the first 5601, second 5602 and third 5603 heat exchangers (both at an "input" side 5901 and an "output" side 5902). Working fluid can also be delivered to, or output by, the first 5601, second 5602 and third 5603 heat exchangers in parallel. If the working fluid exiting 5401 is at a high enough temperature, for example 650° C., it may provide sufficient heat to reheat all stages to a suitable input temperature (e.g. 275° C.).

An advantage of system 5010 is that the heat exchangers can operate with a higher pressure on the hot side, which offers potential savings in the cost of the exchanger due to reduced surface area for heat exchange on the hot side. This may be offset by the requirement for more of the heat exchangers to withstand higher pressure, but the embodiment shown in FIG. 6 is intended to show the flexibility in selecting the cheapest heat exchangers by adapting the process within the limits of the present invention.

Figure 7:
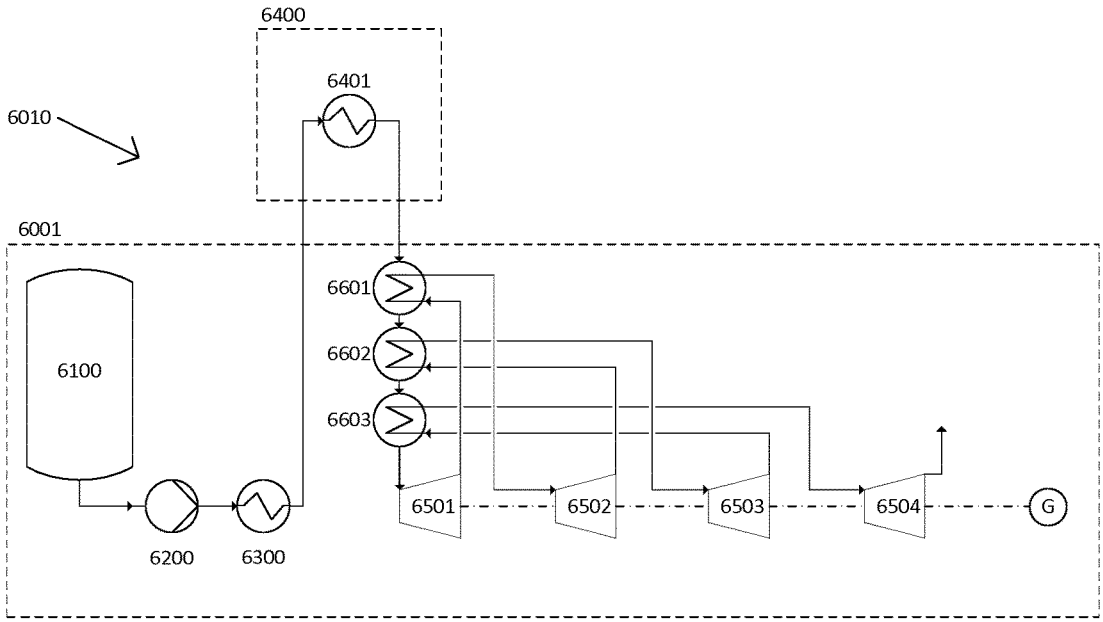
FIG. 7 shows a power recovery system according to a sixth embodiment of the present invention.

FIG. 7 shows a system 6010 according to a sixth embodiment of the present invention. The system comprises first 6601, second 6602 and third 6603 heat exchangers and first 6501, second 6502, third 6503 and fourth 6504 expansion stages. The system 6010 also comprises a cryogenic liquid storage tank 6100 for storing a cryogenic liquid, such as liquid air, a pump (e.g. a cryogenic pump) 6200 and an evaporator 6300. The skilled person will understand that any source of liquid, such as a condenser for producing a liquid from a gas, could be used instead of, or in addition to, the tank 6100. Additionally, the system 6010 comprises a waste heat recovery apparatus 6400 comprising a first 6401 waste heat exchanger that is thermally coupled to a waste heat source, such as an exhaust stack of an Open-Cycle Gas Turbine (OCGT—not shown).

The system 6010 shown in FIG. 7 operates in the same way as the system 1010 shown in FIG. 2, but differs in that the working fluid flows through the first 6601, second 6602 and third 6603 heat exchangers in series. Whilst FIG. 7 shows an embodiment in which the working fluid is transported through the first heat exchanger 6601, second heat exchanger 6602 and third heat exchanger 6603 in that order, it will be understood that, in other embodiments, the working fluid can be transported through the heat exchangers 6601, 6602, 6603 in any order. If the working fluid exiting the first waste heat exchanger 6401 is at a high enough temperature, for example 650° C., it may provide sufficient heat to reheat all stages to 275° C.

An advantage of system 6010 over system 5010 is that it is possible to simplify the pipework required as complex manifold arrangements are not required to divide the stream between multiple heat exchangers.

Figure 8:
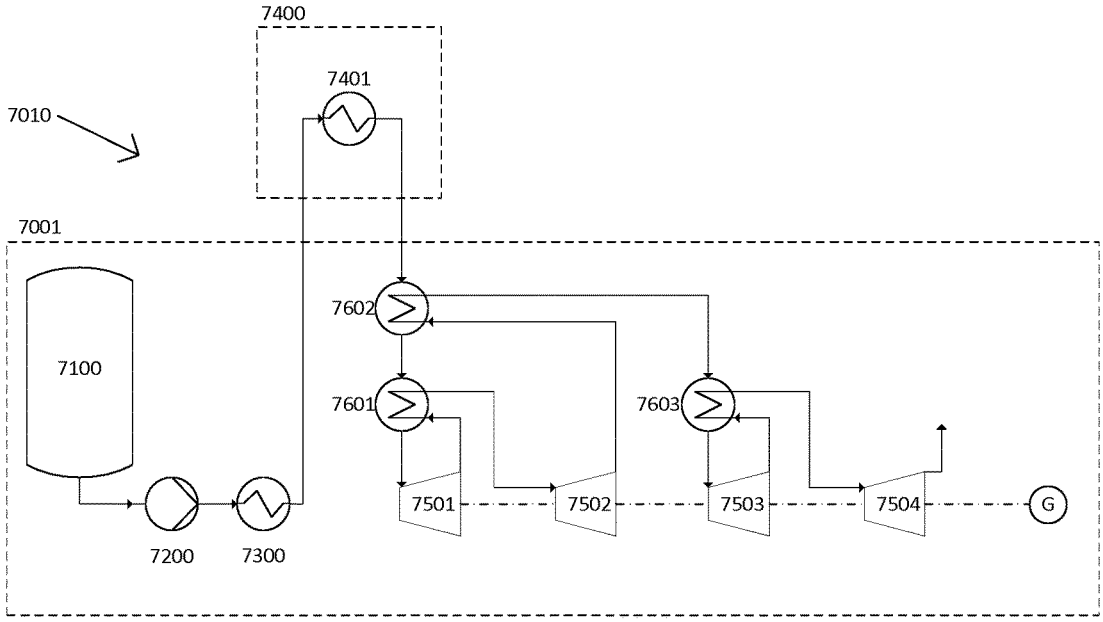
FIG. 8 shows a power recovery system according to a seventh embodiment of the present invention.

FIG. 8 shows a system 7010 according to a seventh embodiment of the invention. The system 7010 comprises first 7601, second 7602 and third 7603 heat exchangers and first 7501, second 7502, third 7503 and fourth 7504 expansion stages. The system 7010 also comprises a cryogenic liquid storage tank 7100 for storing a cryogenic liquid, such as liquid air, a pump (e.g. a cryogenic pump) 7200 and an evaporator 7300. The skilled person will understand that any source of liquid, such as a condenser for producing a liquid from a gas, could be used instead of, or in addition to, the tank 7100. Additionally, the system 7010 comprises a waste heat recovery apparatus 7400 comprising a first 7401 waste heat exchanger that is thermally coupled to a waste heat source, such as an exhaust stack of an Open-Cycle Gas Turbine (OCGT—not shown).

The system 7010 combines aspects of systems 1010 and 6010 described above.

The present invention provides the advantage that the working fluid of a power recovery system is used in place of a conventional intermediate heat transfer fluid to transfer heat between streams of the working fluid within the power recovery system. An advantage of this arrangement is that working fluid may be conveyed fewer times to and from a waste heat recovery apparatus. This results in improved performance and, crucially, reduced pipework costs.

The present invention has been described above in exemplary form with reference to the accompanying drawings which represent a single embodiment of the invention. It will be understood that many different embodiments of the invention exist, and that these embodiments all fall within the scope of the invention as defined by the following claims.

The invention claimed is:

1. A power recovery system for recovering power from a working fluid, comprising:

a first heat exchanger that is configured to receive a first stream of the working fluid; and one or more expansion stages for expanding the working fluid to recover power from the working fluid, wherein the one or more expansion stages is in fluid communication with the first heat exchanger, wherein the first heat exchanger is configured to transfer heat between the first stream of the working fluid and a second stream of the working fluid that is received from the one or more expansion stages;

wherein the first heat exchanger is configured to transfer heat from the first stream of the working fluid to the second stream of the working fluid that is received from the one or more expansion stages;

wherein the heat that is transferred by the first heat exchanger is recovered by cooling the first stream of the working fluid;

wherein the first heat exchanger is configured to receive the first stream of the working fluid from a working fluid input;

wherein the working fluid input comprises:

a source of a liquid, a pump for pumping the liquid to a high pressure, and an evaporator for evaporating the liquid to form a gaseous working fluid;

and wherein the source of the liquid comprises a liquid storage tank or a condenser for producing the liquid from a gas.

2. A system according to claim 1, wherein the working fluid is a gaseous working fluid.

3. A system according to claim 1, wherein each of the one or more expansion stages comprises an expander for expanding the working fluid to recover power.

4. A system according to claim 1, wherein the liquid comprises a cryogen, such as liquid air or liquid nitrogen.

5. A system according to claim 1, wherein the first heat exchanger is configured to receive the first stream of the working fluid from another heat exchanger or an expansion stage.

6. A system according to claim 1, further comprising a waste heat recovery apparatus for recovering heat from an external process and using the recovered heat to heat the first stream of the working fluid before the first stream of the working fluid is transported to the first heat exchanger;

wherein the waste heat recovery apparatus comprises one or more waste heat exchangers.

7. A system according to claim 6, wherein the waste heat recovery apparatus is for recovering waste heat from an external process, wherein the waste heat recovery apparatus is for recovering waste heat from hot gas in an external process or from an exhaust of an external process.

8. A system according to claim 6, wherein the waste heat recovery apparatus is configured to heat the first stream of the working fluid to a temperature that is higher than an inlet temperature of a first expansion stage.

9. A system according to claim 1, wherein the first heat exchanger is configured to cool the first stream of the working fluid to an inlet temperature of a first expansion stage prior to the first stream of the working fluid being expanded in the first expansion stage.

10. A system according to claim 9, wherein the first expansion stage is configured to return expanded working fluid to the first heat exchanger as the second stream of the working fluid, wherein the first heat exchanger is configured to transfer heat from the first stream of the working fluid to the second stream of the working fluid and output the heated second stream of the working fluid as a third stream of the working fluid; and further comprising a second expansion stage that is configured to receive the third stream of the working fluid and expand the third stream of the working fluid to recover power from the third stream of the working fluid.

11. A power recovery system for recovering power from a working fluid, comprising:

a first heat exchanger that is configured to receive a first stream of the working fluid; and one or more expansion stages for expanding the working fluid to recover power from the working fluid, wherein the one or more expansion stages is in fluid communication with the first heat exchanger;

wherein the first heat exchanger is configured to transfer heat between the first stream of the working fluid and a second stream of the working fluid that is received from the one or more expansion stages;

wherein the first heat exchanger is configured to cool the first stream of the working fluid to an inlet temperature of a first expansion stage prior to the first stream of the working fluid being expanded in the first expansion stage;

wherein the first expansion stage is configured to return expanded working fluid to the first heat exchanger as the second stream of the working fluid;

wherein the first heat exchanger is configured to transfer heat from the first stream of the working fluid to the second stream of the working fluid and output the heated second stream of the working fluid as a third stream of the working fluid;

further comprising a second expansion stage that is configured to receive the third stream of the working fluid and expand the third stream of the working fluid to recover power from the third stream of the working fluid; and further comprising a second heat exchanger that is configured to cool the third stream of the working fluid to an inlet temperature of the second expansion stage prior to the third stream of the working fluid being expanded in the second expansion stage.

12. A system according to claim 11, wherein the second heat exchanger is configured to transfer heat from the third stream of the working fluid to a fourth stream of the working fluid to be transported to the one or more expansion stages.

13. A system according to claim 11, wherein the second expansion stage is configured to return expanded working fluid to the second heat exchanger as a fourth stream of the working fluid.

14. A system according to claim 13, wherein the second heat exchanger is configured to transfer heat from the third stream of the working fluid to the fourth stream of the working fluid and output the heated fourth stream of the working fluid as a fifth stream of the working fluid.

15. A system according to claim 11, wherein at least one heat exchanger and/or at least one expansion stage is configured to return the working fluid to a waste heat recovery apparatus so that the working fluid can be reheated before further expansion and/or heat exchange.

16. A system according to claim 1, comprising at least one valve configured to control a bypass flow of the working fluid to bypass at least one heat exchanger to control a temperature of the first stream of the working fluid exiting the heat exchanger.

17. A system according to claim 1, wherein the working fluid is produced from a cryogen, such as liquid air.

18. A method of using a working fluid within a power recovery system comprising:

providing a first heat exchanger within the power recovery system with a first stream of the working fluid; and using the first heat exchanger to transfer heat between the first stream of the working fluid and a second stream of the working fluid that is received from one or more expansion stages;

wherein the first heat exchanger is configured to transfer heat from the first stream of the working fluid to the second stream of the working fluid that is received from the one or more expansion stages;

wherein the heat that is transferred by the first heat exchanger is recovered by cooling the first stream of the working fluid;

wherein the first heat exchanger is configured to receive the first stream of the working fluid from a working fluid input;

wherein the working fluid input comprises:

a source of a liquid, a pump for pumping the liquid to a high pressure, and an evaporator for evaporating the liquid to form a gaseous working fluid;

and wherein the source of the liquid comprises a liquid storage tank or a condenser for producing the liquid from a gas.

19. A method according to claim 18, further comprising:

using the first heat exchanger to transfer heat from the first stream of the working fluid to the second stream of the working fluid; and cooling the first stream of the working fluid to recover the heat to transfer to the second stream of the working fluid and expanding the first stream of the working fluid in a first expansion stage to recover power from the first stream of the working fluid.

20. A method according to claim 18, further comprising:

returning the expanded first stream of the working fluid to the first heat exchanger as the second stream of the working fluid; and outputting the heated second stream of the working fluid from the first heat exchanger as a third stream of the working fluid.

21. A method according to claim 18, wherein the working fluid is a gaseous working fluid.

22. A method according to claim 18, further comprising using a waste heat recovery apparatus to recover heat from an external process and using the recovered heat to heat the first stream of the working fluid before the first stream of the working fluid is transported to the first heat exchanger, wherein the waste heat recovery apparatus comprises one or more waste heat exchangers.

23. A method according to claim 22, wherein the waste heat recovery apparatus recovers waste heat from an external process, wherein the waste heat recovery apparatus is for recovering waste heat from a hot gas in an external process or from an exhaust of an external process.

24. A method according to claim 22, wherein the waste heat recovery apparatus heats the first stream of the working fluid to a temperature that is higher than an inlet temperature of a first expansion stage.

25. A method according to claim 22, further comprising returning the working fluid from at least one heat exchanger and/or at least one expansion stage to the waste heat recovery apparatus so that the working fluid can be reheated before further expansion and/or heat exchange.

26. A method according to claim 18, wherein the working fluid is produced by evaporating a liquid to form a gas and pumping the gas to a high pressure.

27. A method according to claim 18, wherein the working fluid is produced from a cryogen, such as liquid air.

28. A method according to claim 1, wherein the first heat exchanger is configured to cool the first stream of the working fluid to an inlet temperature of a first expansion stage prior to the first stream of the working fluid being expanded in the first expansion stage;

wherein the first expansion stage is configured to return expanded working fluid to the first heat exchanger as the second stream of the working fluid;

wherein the first heat exchanger is configured to transfer heat from the first stream of the working fluid to the second stream of the working fluid and output the heated second stream of the working fluid as a third stream of the working fluid;

further comprising a second expansion stage that is configured to receive the third stream of the working fluid and expand the third stream of the working fluid to recover power from the third stream of the working fluid;

further comprising a second heat exchanger that is configured to cool the third stream of the working fluid to an inlet temperature of the second expansion stage prior to the third stream of the working fluid being expanded in the second expansion stage;

wherein the second heat exchanger is configured to transfer heat from the third stream of the working fluid to a fourth stream of the working fluid to be transported to the one or more expansion stages; and wherein the second expansion stage is configured to return expanded working fluid to the second heat exchanger as the fourth stream of the working fluid.

29. A system according to claim 1, wherein a last stream of the working fluid is exhausted to atmosphere after being expanded by a last stage of the one or more expansion stages.

30. A method according to claim 18, further comprising receiving a last stream of the working fluid from a last stage of the one or more expansion stages and exhausting the last stream of the working fluid to atmosphere.

* * * * *